US005803467A

United States Patent [19]

Piotrowski

[11] Patent Number: 5,803,467

[45] **Date of Patent: *Sep. 8, 1998**

[54] ADJUSTABLE FOOT EQUIPMENT

[75] Inventor: David J. Piotrowski, Larchmont, N.Y.

[73] Assignee: DP Systems LLC, Champaign, Ill.

[ * ] Notice: The term of this patent shall not extend beyond the expiration date of Pat. No. 5,615,901.

[21] Appl. No.: 822,241

[22] Filed: Mar. 20, 1997

Related U.S. Application Data

[62] Division of Ser. No. 333,374, Nov. 2, 1994, Pat. No. 5,615,901.

[51] Int. Cl.[6] ..... A63C 1/00

[52] U.S. Cl. ..... 280/7.14; 280/11.19; 280/11.27; 280/618; 280/11.3

[58] Field of Search ..... 280/7.12, 7.14, 280/11.19, 11.27, 618, 11.3, 633, 617, 607

[56] References Cited

U.S. PATENT DOCUMENTS 3,817,543 6/1974 Haff ..... 280/607
3,917,298 11/1975 Haff ..... 280/607
5,188,386 2/1993 Schweizer ..... 280/633
5,615,901 4/1997 Piotrowski ..... 280/7.14

*Primary Examiner*—Richard M. Camby
*Attorney, Agent, or Firm*—Rodman & Rodman

[57] ABSTRACT

The adjustable foot equipment is adaptable to ski boots, in-line roller skates, ice skates, water skis and snowboards, and includes a base formed with a depending appendage adapted to be joined with a support member. The appendage and the support member are formed with complementary engaging curved surfaces that permit relative pivotal movement between a foot holding portion of the foot equipment and the support member. Once a desired offset angular orientation between the support member and the foot holding portion is determined, a securing arrangement locks the support member to the appendage. The securing arrangement can be easily released to permit resetting of a selected offset angular orientation. Some embodiments of the invention permit permanent adjustment of a selected offset angular orientation.

20 Claims, 10 Drawing Sheets

FIG. 1
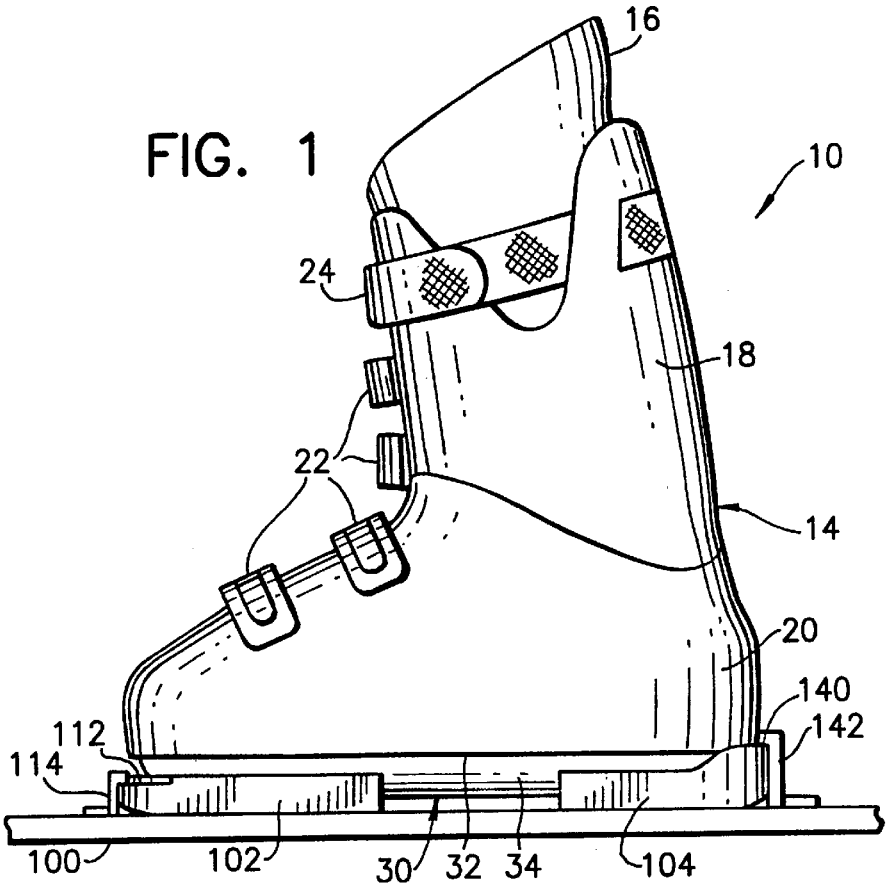
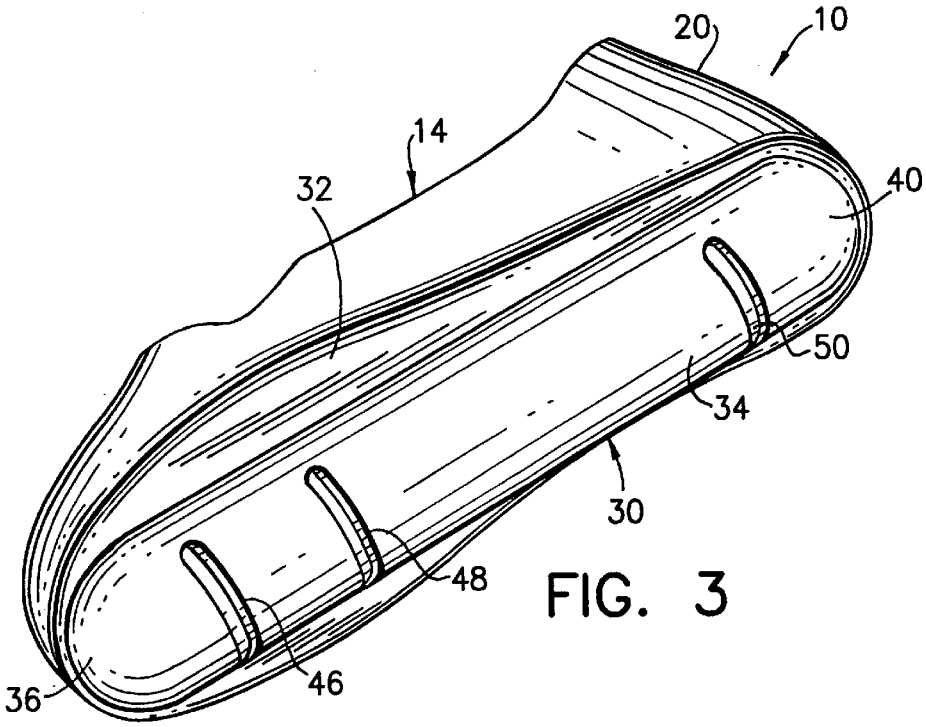
FIG. 3

ADJUSTABLE FOOT EQUIPMENT

This application is a continuation of application Ser. No. 08/333,374 filed Nov. 2, 1994 and issuing as U.S. Pat. No. 5,615,901 on Apr. 1, 1997.

BACKGROUND OF THE INVENTION

This invention relates to adjustable foot equipment for such activities as snow skiing, snowboarding, water skiing, roller skating, ice skating, walking and running.

It is well known that the most prevalent posture conditions or categories of a person's legs are legs which are commonly referred to as bowing inwardly toward each other, bowing outwardly and away from each other, and legs which are in a substantially vertical orientation. In various other leg posture conditions, the leg orientation can deviate slightly inwardly or outwardly from a vertical reference plane located between the legs.

The particular leg orientation which is optimal for different sports is debatable and subject to considerable differences of opinion. In skiing, for example, given current designs of boots and skis, it is considered optimal for the legs to be oriented approximately vertically.

Foot engageable equipment used in skiing is generally designed to fit an "average user's" leg orientation in a standing position relative to the ground. However, the so-called "average user's" leg orientation is not necessarily a vertical orientation. Because many people do not have leg orientations that conform to the target leg orientation that is designed into a particular piece of foot engageable equipment, such equipment may exaggerate an individual's leg deviation from the vertical reference plane, which in many instances is undesirable.

Consequently, depending upon an individual's normal leg orientation, foot engageable equipment can place the legs in a position that is either beneficial or detrimental to the user's performance. This in turn may lead to increased or decreased performance proficiency, depending on the user, and the application.

The term "off-vertical leg orientation" is intended to refer to the amount of deviation of an individual's legs from a vertical reference plane between the legs. Off-vertical leg orientation can be measured while the foot engageable equipment is being worn and the user is standing in what is considered a "normal" standing position, or when the user is not wearing any foot engageable equipment. For discussion purposes, it will be assumed that vertical leg orientation with foot equipment being worn is the desired objective for obtaining optimal performance and proficiency.

Thus, in skiing, the optimal leg posture position with foot engageable equipment is considered to be a position of vertical orientation while the ski bases are horizontally flat on the snow. Preferably the orientation of the legs should be symmetrical.

During turns, rotational and angular movements of the legs and body are used to turn and edge the skis as well as create desirable body positions. These movements serve a dual purpose of creating direction changes as well as placing the center of mass of the body in a position to balance against the forces generated while turning.

A skier who starts out with an off-vertical leg orientation may be unable to simultaneously create both the proper edge angle and body tilt necessary for proficient turning movements. This forces the skier to compensate by using exaggerated or inefficient movement patterns as part of his or her technique, such as overuse of femoral rotation, excessive abduction of the knee joint, hip flexion, etc.

It is thus well known that skill development and proficiency in skiing are usually easier to accomplish if one's leg orientation is vertical wherein the side edges of the ski are generally in a plane that is substantially horizontal to the ground. Skiers whose leg orientation deviates from the vertical, such that there is an off-vertical leg orientation, experience difficulty in both balancing and edging abilities. Such skiers have recently been the focus of numerous attempts to compensate for the off-vertical condition.

For example, U.S. Pat. No. 3,732,635 to Marker shows a ski boot upper that is pivotal with respect to a tub-like sole. Pivotal adjustment is accomplished via front and rear brackets that permit universal adjustment of the upper relative to the tub-like sole. However, this structure is difficult to adjust, and once adjusted can easily go out of adjustment because of relative flexion between the brackets.

U.S. Pat. No. 4,078,322 to Dalebout shows heel and toe piece elements for a ski boot to provide specific cant angles adapted to a particular skier's needs. The heel and toe pieces can either be standard stock items provided in specific angular increments or a custom-made heel and toe piece for individual requirements. A further variation of this theme is shown in U.S. Pat. No. 5,293,702. Neither of these patents show a device that permits simple readjustment from one angular condition to another.

U.S. Pat. No. 4,945,659 to DeMarchi et al shows sole portions adapted to fit on the front and rear tenons of a ski boot to provide desired correction for a bow-legged or knock-kneed skier. This device also does not permit simple readjustment from one adjusted condition to another.

U.S. Pat. No. 4,601,118 to Zanatta shows an inclination adjustor provided on an upper portion of a boot to adjust the inclination of the upper portion relative to the lower portion. This device is also difficult to change when readjustment is necessary.

It is thus desirable to provide a simple adjustable means for foot equipment that compensates for off-vertical leg orientation that is relatively easy to use and permits further readjustment when needed. It is also desirable to provide adjustment means adaptable to different foot equipment used for different activities.

OBJECTS AND SUMMARY OF THE INVENTION

Among the several objects of the invention may be noted the provision of novel adjustable foot equipment, novel adjustable foot equipment wherein foot retention means and support means for the foot retention means are adjustable to selected angular orientations, novel adjustable foot equipment wherein foot retention means and a support for the foot retention means can be locked in position at a selected angular orientation, novel adjustable foot equipment that permits a foot retention member to pivot relative to a support member and vice versa while maintaining the foot on a desired center of rotation, novel adjustable foot equipment that permits a foot retention member to pivot relative to a support member and vice versa while maintaining the foot on a predetermined longitudinal element of a sole member, novel adjustment means for foot equipment that is adaptable to different types of foot equipment for different activities, novel adjustable foot equipment that corrects off-vertical leg orientation to provide the equivalent of a vertical leg orientation, novel adjustment means for foot equipment that allows for adjustment to any leg orientation, depending on the sport or the preference of the user, novel adjustment means for foot equipment that permits quick and easy adjustment of leg orientation and readjustment when necessary, and a novel method of providing a selected leg orientation.

Other objects and features of the invention will be in part apparent and in part pointed out hereinafter.

In accordance with the invention, the adjustable foot equipment includes foot holding means for accommodating a foot. The foot holding means has a base formed with a depending appendage. A substantially rigid support means is joined to the appendage to permit relative pivotal movement between the foot holding means and the support means to selected angular orientations. The pivotal movement is about an axis extending longitudinally of the base portion of the foot holding means. The invention further includes securing means for locking the support means and the base portion together at a predetermined angular orientation that compensates for the off-vertical leg orientation of the user or allows the leg orientation of the user to be set as desired.

The appendage has a convex outer surface and the support means has a complementary concave surface to engage with the appendage. Preferably, the appendage has a semicylindrical contour and the concave surface of the support means conforms with the cylindrical contour of the appendage.

The center of curvature of the appendage lies within the foot holding means, preferably at a longitudinal middle portion of an inner sole member.

In several embodiments of the invention the securing means includes a fastener that extends from the support means through the appendage to engage a connection member within a hollow portion of the appendage.

In another embodiment of the invention, the securing means includes a rivet-like fastener that extends from the support means to engage directly with the appendage.

In still another embodiment of the invention, the appendage is a solid formation and the securing means includes a fastener that extends from the support means directly into the solid portion of the appendage.

In a further embodiment of the invention, a kit for adjustable foot equipment includes a base member for a foot holding means. The base member has the depending appendage formed with a convex surface. The kit also includes the support means and the securing means of previous embodiments of the invention. The base member is adapted to be joined to a foot holding means, such as a boot, wherein the bottom is removed. The base portion of the kit thus forms the bottom portion of the bottomless boot. The combination of the base portion with the support means and the securing means provides the boot with selective offset angular adjustability.

The adjustable foot equipment is adaptable to ski boots, in-line roller skating boots, ice skate boots, walking shoes, snowboards and water skis, for example.

Indicia means provided on the foot holding member and the support means permit easy adjustment of a predetermined angular offset between the foot holding means and the support means.

In several embodiments of the invention the adjustable foot equipment can be repeatedly adjusted by simply loosening the securing means and retightening them to a desired offset position.

In another embodiment of the invention, the adjustable foot equipment can be set at a permanent offset angular position.

In all embodiments of the invention, it is relatively easy to establish an offset angular orientation between a support means and a foot holding member to compensate for off-vertical leg orientation.

The invention accordingly comprises the constructions and method hereinafter described, the scope of the invention being indicated in the claims.

DESCRIPTION OF THE DRAWINGS

In the accompanying drawings,

FIG. 1 is a simplified schematic elevational view of adjustable foot equipment incorporating one embodiment of the invention;

FIG. 3 is a fragmentary bottom perspective view of the foot retention portion thereof;

Corresponding reference characters indicate corresponding parts throughout the several views of the drawings.

DETAILED DESCRIPTION OF THE INVENTION

Figure 2:
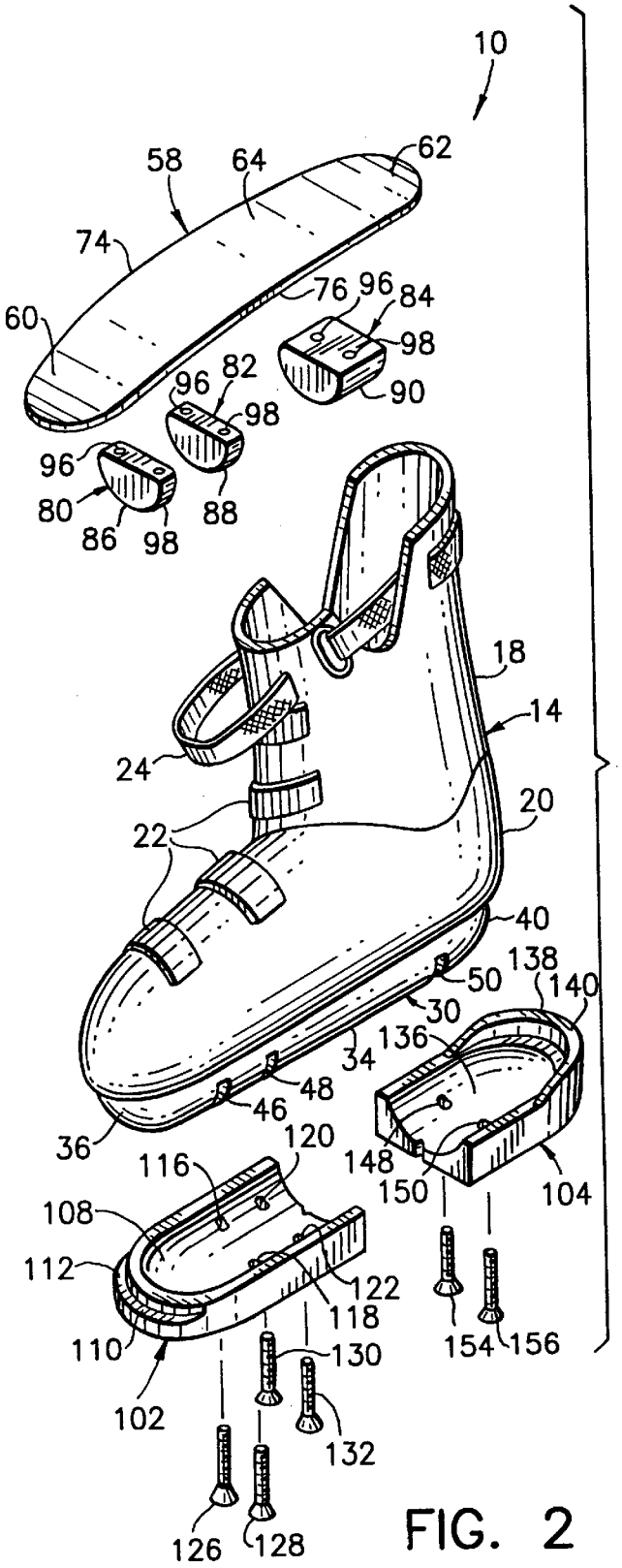
FIG. 2 is an exploded perspective view thereof.

Adjustable foot equipment incorporating one embodiment of the invention is generally indicated by the reference number 10 in FIG. 1.

The foot equipment 10 is in the form of a ski boot having an upper foot retention portion 14 of conventional known plastic ski boot construction. The foot retention portion 14 includes a pliable inner boot 16 extending from a rigid plastic ankle shell portion 18 that is hinged to a rigid plastic foot enclosure shell portion 20.

Known securement members such as buckles 22 and a strap 24 are provided on the ankle portion 18 and the foot enclosure portion 20 as shown in FIG. 1.

The invention is adaptable to any current known ski boot construction formed of rigid or flexible outer shells.

Referring to FIGS. 2 and 3, an appendage 30 that can be molded integrally with the foot enclosure portion 20 depends from a marginal base portion 32 of the boot 10. The appendage 30 is formed of a rigid plastic semi-cylindrical shell or wall 34 with a curved and closed toe end portion 36 and a similar curved and closed heel end portion 40. However, it should be noted that the shape of the end portions 36 and 40 is a matter of choice. A pair of spaced slots 46 and 48 are provided in the appendage wall 34 near the toe end 36 and a slot 50 is provided near the heel end 40. The marginal base portion 32 and the appendage 30 form the base of the foot retention portion 14.

Figure 5:
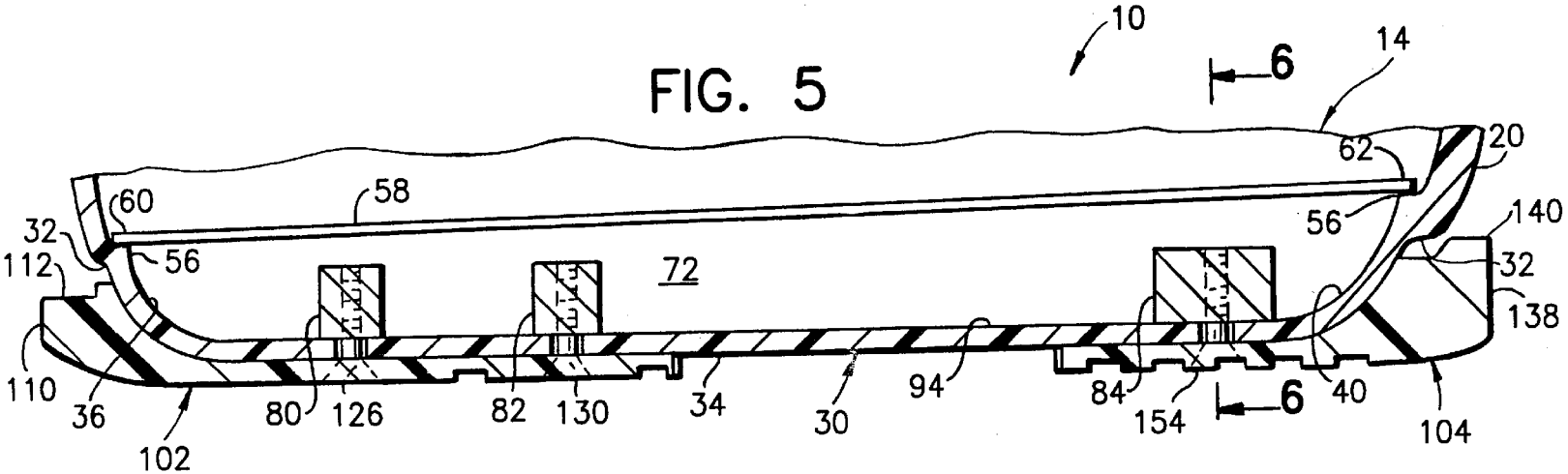
FIG. 5 is a fragmentary sectional view thereof taken on the line 5—5 of FIG. 4.
Figure 6:
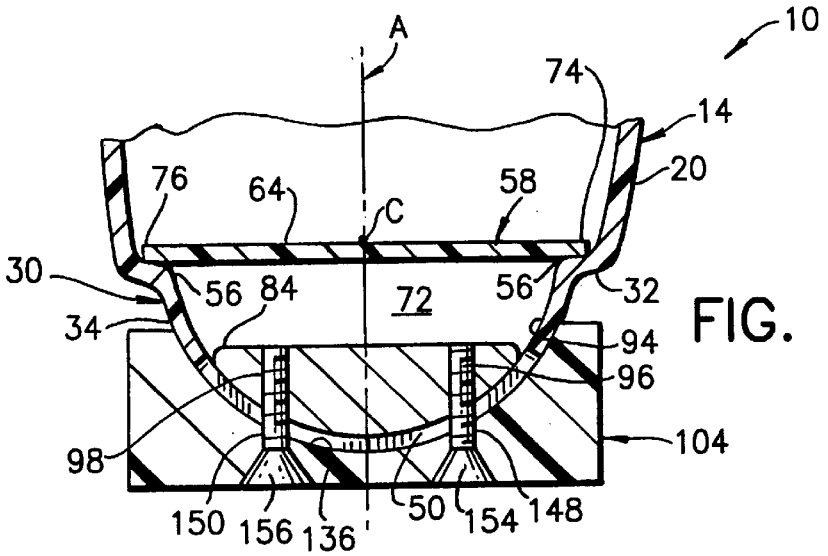
FIG. 6 is a fragmentary sectional view thereof taken on the line 6—6 of FIG. 5.

Referring to FIGS. 5 and 6, the marginal base portion 32 forms an inner marginal ledge 56 within the foot enclosure portion 20 to support a sole plate or inner sole member 58. The sole member 58 is preferably formed of plastic and has a toe end 60 and a heel end 62 corresponding to the toe end portion 36 and the heel end portion 40 of the appendage 30. Although not shown for purposes of clarity, the sole member 58 can be provided with any suitable known heel and arch support structure. The sole member 58 is disposed against or detachably secured to the marginal ledge 56. A space 72 is thus defined between the appendage wall 34 and the sole member 58.

Figure 6A:
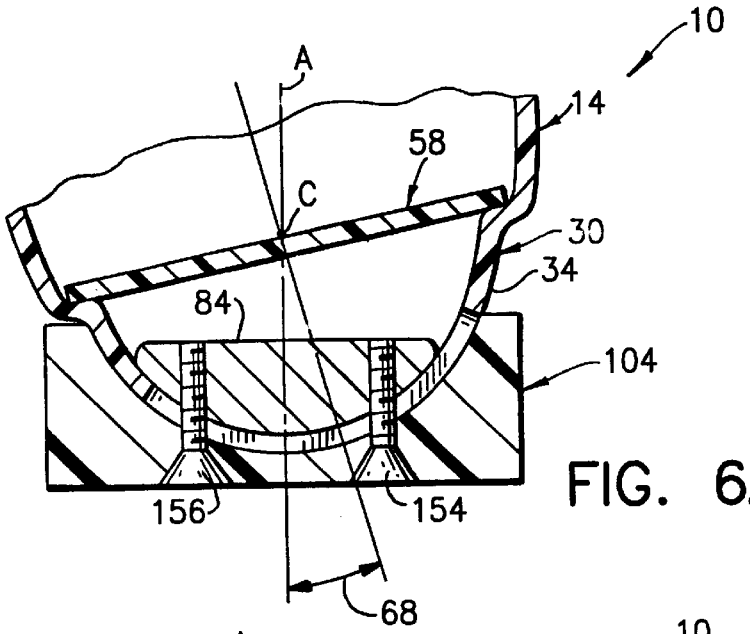
FIGS. 6*a* and 6*b* are fragmentary sectional views similar to FIG. 6 showing different angular offset adjustments thereof.
Figure 6B:
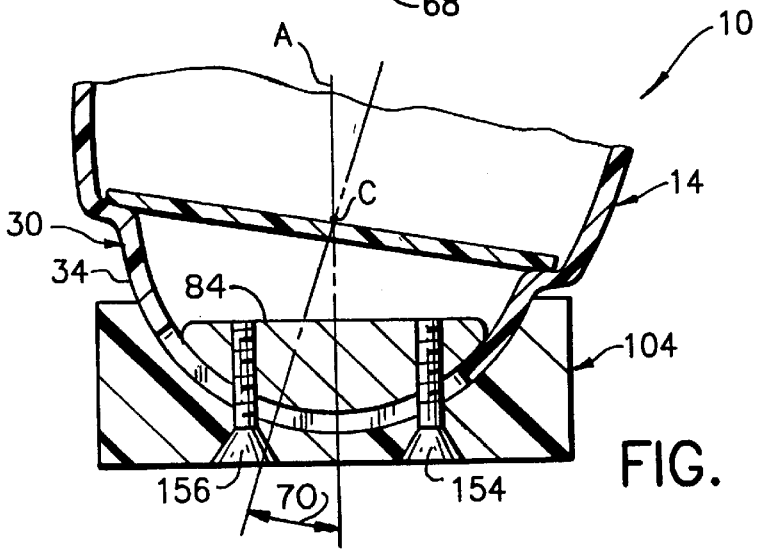

Referring to FIG. 6, the radial size of the appendage 30 and the positioning of the sole member 58 are so selected that a center of curvature C of the semi-cylindrical wall portion 34 of the appendage 30 coincides with an upper surface 64 of the sole member 58. The center of curvature C also lies on a plane that passes through the longitudinal mid-portion of the base of the foot retention portion 14, where such plane intersects the upper surface of the sole member 58. For purposes of visual simplification, the center of curvature C will also be referred to as lying approximately at a mid-portion of the sole member 58, such as shown in FIGS. 6, 6A and 6B.

The simplified location of the center of curvature C of the appendage at the mid-portion of the sole member 58 will be presumed in all embodiments of the invention unless otherwise indicated.

Referring to FIGS. 2 and 6, three connection members 80, 82 and 84 in the form of semi-cylindrical segments are disposed in the appendage space 72. The connection members 80, 82 and 84 are preferably formed of metal such as aluminum and include respective curved surfaces 86, 88 and 90 (FIG. 2) that are complementary to the inner curved surface 94 of the appendage wall 34. Each of the connection members 80, 82 and 84 includes a pair of spaced and threaded holes 96 and 98.

Referring to FIG. 2, a pair of support members 102 and 104, preferably formed of plastic or other suitable material, are respectively provided at the toe end 36 and the heel end 40 of the appendage 30. The toe end support member 102 includes a concave upper surface 108 that is complementary to the toe end surface 36 of the appendage 30. A plane of symmetry, shown as the line A in FIG. 6, of the concave surface 108 aligns with the center of curvature C of the appendage wall 34, and also passes through the mid-portion of the support member 102.

The line A is also used as a vertical reference line to measure angular offset from the vertical. The angular offset from the vertical is the off-vertical orientation correction angle. For purposes of simplification, the line A as seen in FIG. 6 can also be referred to as an axis of symmetry.

A curved end portion 110 of the support member 102 is formed with a step 112 of predetermined size to define what is commonly referred to as a DIN surface.

Most modern ski boots are manufactured in accordance with the DIN 7880 Standard Specification for ski boot dimensions. Similar standards have been adopted by the International Standards Organization (ISO) and the American Society for Testing of Materials (ASTM). These standards define the critical shapes at the toe and heel of a ski boot, to help insure compatibility with ski bindings that meet DIN norm 7881.

Thus, the step 112 constitutes a DIN surface sized to meet the standard DIN specifications for engagement with a known compatible toe end ski binding 114 (FIG. 1) of a known conventional ski 100. The binding 114 is usually located on the ski 100 such that the axis of symmetry A of the support member 102 aligns with the longitudinal mid-portion of the ski 100.

The support member 102 further includes two pairs of spaced unthreaded holes 116, 118, 120 and 122 adapted to align with the threaded holes 96 and 98 of the connection members 80 and 82. Four screws 126, 128, 130 and 132 pass through the support member 102 and the slots 46 and 48 of the appendage wall 34 to engage the threaded holes 96 and 98 of the connection members 80 and 82.

The heel end support member 104 includes a concave upper surface 136 that is complementary to the heel end surface 40 of the appendage 30. The concave surface 136 has the same plane of symmetry as the concave surface 108 (shown as the line A in FIG. 6). The line A or axis of symmetry aligns with the center of curvature C of the appendage wall 134 and also passes through the mid-portion of the support member 104.

A curved end portion 138 of the support member 104 is formed with a ledge 140 of predetermined height to define a DIN surface of standard size. The DIN surface 140 engages a known compatible heel end ski binding 142 (FIG. 1) on the ski 100. The binding 142 is preferably located on the ski 100 such that the axis of symmetry A of the support member 104 aligns with the longitudinal mid-portion of the ski 100.

The support member 104 further includes a pair of spaced and unthreaded holes 148 and 150 adapted to align with the threaded holes 96 and 98 of the connection member 84. Two screws 154 and 156 pass through the support member 104 and the slot 50 of the appendage wall 34 to engage the threaded holes 96 and 98 of the connection member 84.

In using the adjustable foot equipment 10 the support members 102 and 104 are loosely connected to the connection members 80, 82 and 84 through the appendage wall 34. The screws 126–132 and 156–158 pass through the support members 102 and 104 and the slots 46–50 of the appendage wall 34 to engage the connection members 80–84. The appendage wall 34 is thus sandwiched between the support members 102 and 104 and the connection members 80–84. In this manner the support members 102 and 104 and the connection members 80, 82 and 84 are held together while being pivoted with respect to the foot retention portion 14.

Figure 4:
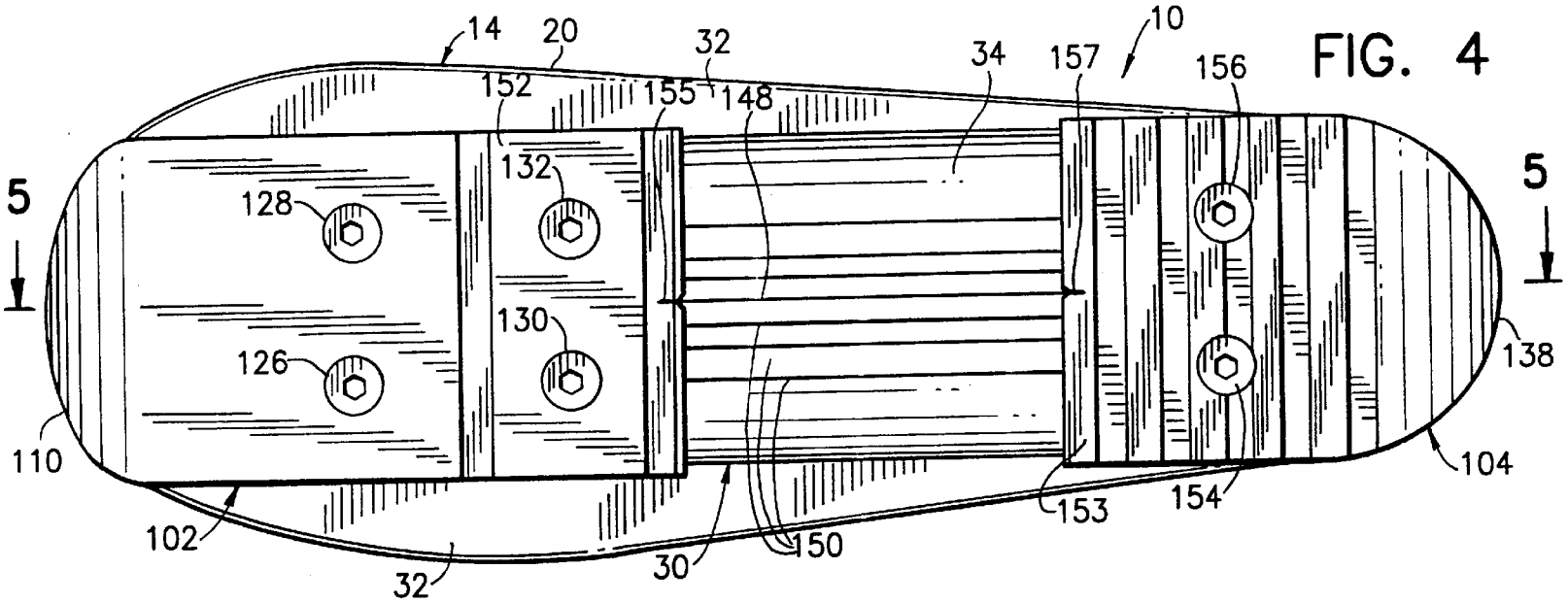
FIG. 4 is a bottom plan view of the adjustable foot equipment.

A determination is made of a skier's leg orientation in a normal standing position relative to the vertical reference axis A. This determination can be made while the skier is wearing the boot 10. If the skier's leg orientation deviates from the vertical axis A, a measurement of such off-vertical angular deviation is made. An appropriate angular adjustment is made to the support members 102 and 104 by use of pre-marked indicia lines such as 150 (FIG. 4) on the outer surface of the appendage 30.

The indicia lines 150 each represent a predetermined angular displacement from a zero degree reference line 146 that corresponds to zero degree deviation from the vertical reference axis A. The indicia lines, such as 150, extend between the support members 102 and 104 and are marked in appropriate angular increments. In addition, the mid-portion of respective base surfaces 152 and 153 of each of the support members includes reference marks 155 and 157. The reference marks 155 and 157 align with the zero degree indicia line 148 on the appendage 30 when there is zero degree offset between the foot retention portion 14 and the support members 102 and 104. For example, FIG. 6 shows a zero degree offset condition between the foot retention portion 14 and the support member 104.

Once a measurement is made of a skier's off-vertical leg orientation in a normal standing position, such measurement is used to adjust the relative offset position between the support members 102 and 104 and the foot retention member 14 for the off-vertical leg orientation. Such adjustment is made by pivoting the support members 102 and 104 or the foot retention member 14 relative to each other by the measured angular amount such that the reference marks 155 and 157 align with corresponding angular indicia 150 on the appendage 30.

In this manner a predetermined angular offset between the foot retention member 14 and the support members 102 and 104 is provided to compensate for any deviation between a skier's legs from a vertical reference axis. Thus, if one of the skier's legs has a 10 degree counterclockwise deviation from the vertical, the appropriate correction is a 10 degree clockwise offset between the support members 102 and 104 and the foot retention portion 14, such as shown at reference number 68 in FIG. 6A.

Since the mid-portion of the sole member 58 aligns with the longitudinal mid-portion of the ski 100 and the center of curvature C of the appendage 30 or pivot center of the boot 10 is also at the middle of the sole member 58, the center of curvature C remains aligned with the middle of the ski 100 for all angular adjustments of the boot 10.

Thus, when the appendage 30 is loosely engaged with the support members 102 and 104, the support members are pivotable about an axis extending longitudinally of the foot retention member 14 at the sole portion 58 and passing through the center of curvature C. Similarly, the foot retention member 14 is pivotable with respect to the support members 102 and 104 about the same longitudinal axis of the foot retention member that passes through the center of curvature C. Under this arrangement, a foot located in the boot 10 will remain at the longitudinal mid-portion of the ski 100 for all angular adjustments of the boot 10.

Further offset angular adjustments can be made with regard to the other leg such as indicated by the reference number 70 in FIG. 6B. Different magnitudes of angular adjustment are made for each leg where warranted.

It should also be noted that an angular offset adjustment between one of the support members, such as the heel end support member 104 and the foot retention portion 14, can facilitate adjustment between the other support member 102 and the foot retention portion 14.

For example, the toe end support member 102 can be adjusted to correspond to the angular offset position of the previously adjusted heel end support member 104 by standing the boot 10 on a horizontal surface such as a table-top. The angular adjustment between the heel end support member 104 and the foot retention portion 14 is used to control the angular adjustment between the toe end support member 102 and the foot retention portion 14. Final tightening of the toe end support member 102 can thus easily follow the adjustment of the heel end support member 104.

Figure 13:
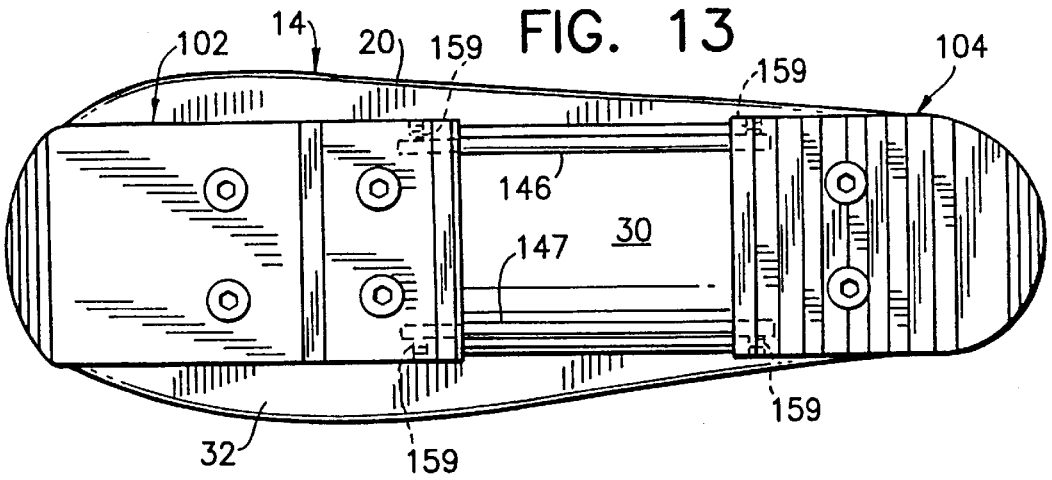
FIG. 13 is a bottom plan view of still another embodiment of the invention.
Figure 14:
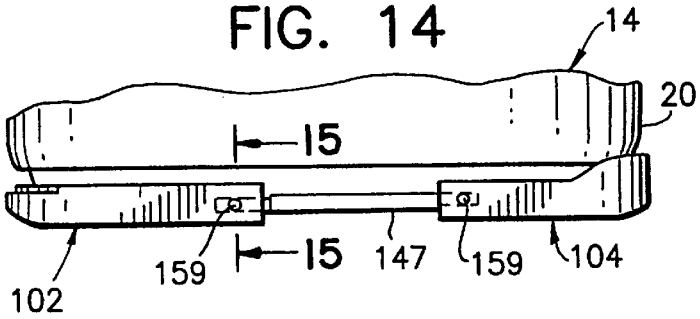
FIG. 14 is a fragmentary elevational view thereof.
Figure 15:
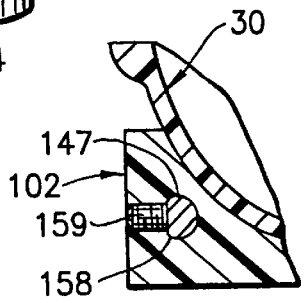
FIG. 15 is a fragmentary sectional view taken on the line 15—15 of FIG. 14.

As shown in FIGS. 13–15, connector rods such as 146 and 147 can be provided to connect the support members 102 and 104. The connector rods 146 and 147 ensure that adjustment of any one support member will result in a corresponding movement of the other support member.

Thus, opposite ends of the rods 146 and 147 are flattened, as indicated at 158 (FIG. 15) and disposed in the support members 102 and 104. A lock screw 159 provided in the support members 102 and 104 is threaded against the flat surface 158 of the rods 146 and 147, to lock the rods 146 and 147 in the support members 102 and 104.

In this manner, movement of both support members 102 and 104 will occur simultaneously to facilitate adjustment of the relative offset between the foot retention portion 14 and the support members 102 and 104.

Figure 16:
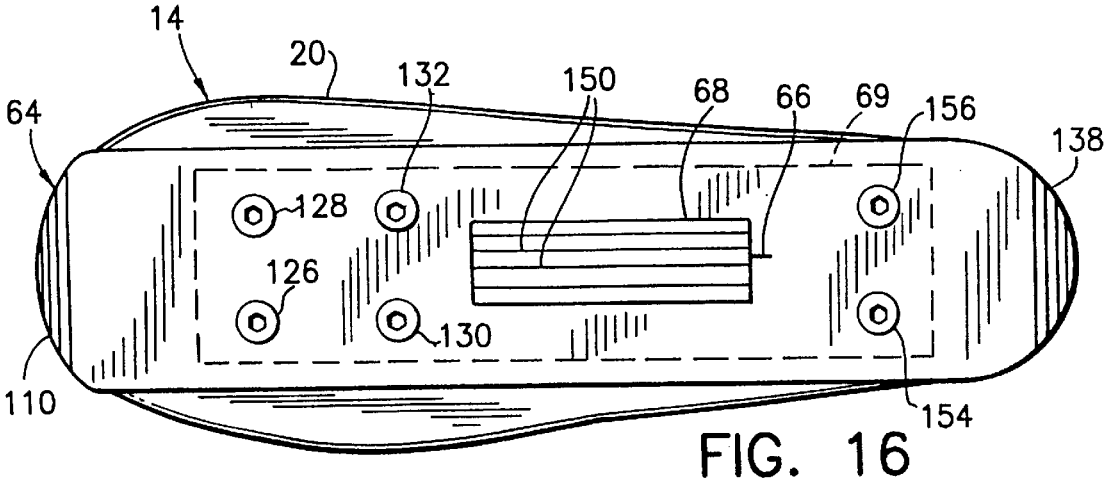
FIG. 16 is a bottom plan view of still another embodiment of the invention.

As a further option, the support members 102 and 104 can be combined to form one support member 64, as shown in FIG. 16. The support member 64 has the general structural characteristics of both of the support members 102 and 104. Securement of the support member 64 to the foot retention portion 14 in a selected angular offset position is accomplished in a manner similar to that previously described for the support members 102 and 104. Also, if desired, the connection members 80, 82 and 84 can be combined to form one connection member. For example, a combined unitary connection member 69, shown dotted in FIG. 16, can be substituted for the members 80, 82 and 84 wherever the separate connection members are used.

An indicator mark 66 is provided alongside an opening 68 in the support member 64 to register with the angular increment indicia 150 on the appendage 30 and permits setting of the angular offset in a manner similar to that previously described.

If desired, the adjustment of the support members 102 and 104 can be made while a skier is wearing the boot 10. Such adjustment is made with the skier standing on a horizontal surface and by pivoting the foot retention member to the desired angular position from the vertical such as shown in FIGS. 6*a* or 6*b*. Once the desired angular position is reached, the screws such as 154 and 156 are tightened to securely lock the support members 102 and 104 and the connection members 80, 82 and 84 against the appendage wall 34.

Although the dimensions of the appendage 30 can vary in accordance with the size of the ski boot, a suitable outside diameter of the appendage is approximately 2.3 inches, with a wall thickness of approximately 3.5 millimeters. The slots 46, 48 and 50 can be approximately 6.7 millimeters wide and approximately 47 millimeters long. The connection members 80 and 82 can be approximately 13 millimeters wide and the connection member 84 can be approximately 26 millimeters wide. The hole spacing can be approximately 28 millimeters and the spacing between the holes on connection members 80 and 82 can be approximately 42 millimeters. The altitude of the connection members is approximately ½ inch and the screws are stainless steel ¼-20. This arrangement should provide at least a 15 degree range of angular adjustment from the vertical reference A.

Figure 7:
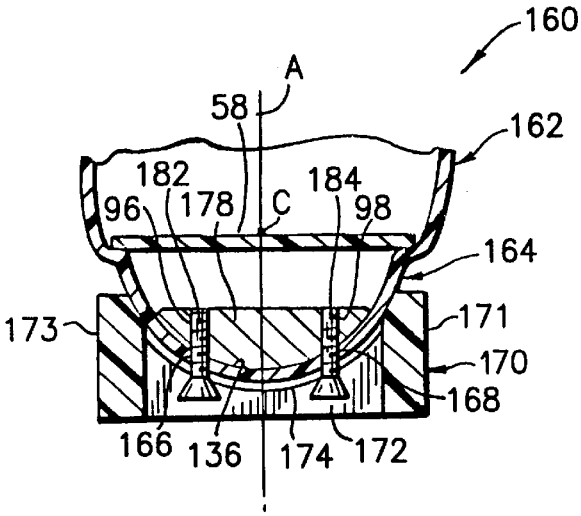
FIG. 7 is a fragmentary sectional view of another embodiment of the invention.

Another embodiment of the adjustable foot equipment, also in the form of a ski boot of the type previously described, is generally indicated by the reference number 160 in FIG. 7.

The main difference between the boot 160 and the boot 10 is in the manner of joining the toe and heel support members to the appendage. For example, the appendage of the boot 160 has fastener holes instead of the slots 46, 48 and 50 of the boot 10. In addition, the support members of the boot 160 have slots instead of the fastener holes 116–122 and 148–150 of the boot 10. The boot 160 is otherwise similar in structure and operation to the boot 10.

Thus, the boot 160 includes a foot retention portion 162 identical to the foot retention portion 14 and an appendage 164 of the same general shape as the appendage 30. However, the appendage 164 has separate fastener holes such as 166 and 168 instead of the slots 46, 48 and 50 of the appendage 30. The appendage 164 is otherwise identical to the appendage 30.

The boot 160 also includes a heel end support member 170 with a slot 172 instead of the fastener holes 148 and 150 of the heel end support member 104. The slot 172 has a reduced width portion 174 near the concave surface 136 of the support member 170. The heel end support member 170 includes equally thick side portions 171 and 173 and is otherwise identical to the heel end support member 104.

A connection member 178 provided inside the appendage 164 is identical to the connection member 84.

A pair of screws 182 and 184 are insertable in the slot 172 such that the screw heads abut against the reduced width portion 174. The screws 182 and 184 pass through the respective fastener holes 166 and 168 of the appendage 164 for engagement with the threaded holes 96 and 98 of the connection member 178.

The slot 172 and the reduced width portion 174 in the heel end support member 170 are also provided in two places in the toe end support member (not shown). The toe end support member (not shown) is otherwise identical to the toe end support member 102. To avoid repetitive description, the details of the toe end support member of the boot 160 are omitted.

The boot 160 is used in a manner similar to that previously described for the boot 10. Thus, an angular offset such as indicated at 186 or 188 between the foot retention portion 162 and the heel end support member 170, for example, is based on a measurement of the off-vertical orientation of the legs. Such measurement also determines the angular offset between the toe end support member (not shown) and the appendage 164. The heel end support member 170 is adjusted to a fixed position against the appendage 164 by tightening the screws 182 and 184 in the connection member 178. The toe end support member (not shown) is similarly secured to the appendage 164 with the same angular offset.

Figure 7A:
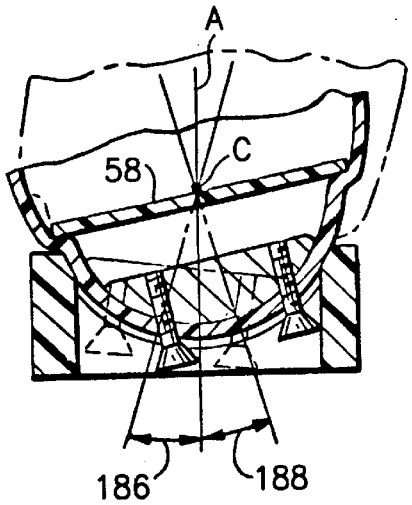
FIG. 7*a* is a fragmentary sectional view similar to FIG. 7 showing different angular offset adjustments thereof.

Referring to FIG. 7A, it should be noted that the line of symmetry A passes through the middle portion of the sole member 58, and coincides with the center of curvature C of the appendage 164. If the ski bindings such as 114 and 142 (FIG. 1) locate the boot 160 at the longitudinal middle portion of the ski 100, the line of symmetry A and the center of curvature C of the foot retention portion 162 align with the longitudinal middle of the ski 100. Thus, any angular adjustment between the appendage 164 and the support member 170 will not displace the center of curvature C, which also represents the middle of a skier's foot (not shown), from the middle of the ski 100.

Figure 10:
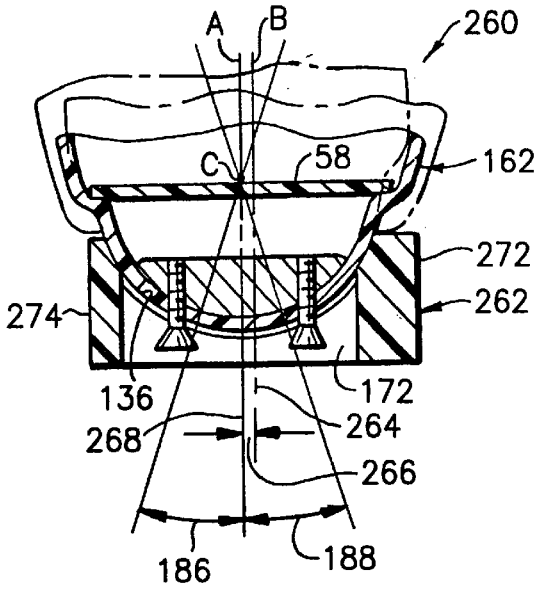
Figure 12:
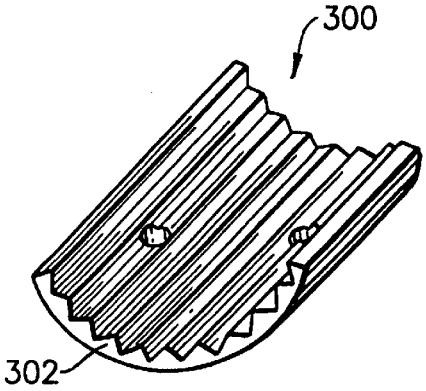
FIG. 12 is a fragmentary perspective view of an insert member thereof.

A further embodiment of the adjustable foot equipment, also in the form of a ski boot of the type previously described, is generally indicated by the reference number 260 in FIG. 10. The boot 260 has many features of the boot 160 including the foot retention portion 162, the appendage 164, the connection member 178, and the screws 166 and 168. A significant distinction between the boot 160 and the boot 260 is a heel end support member 262. The support member 262 includes the concave surface 136 but, as shown in FIG. 10, has a side portion 272 that is thicker than an opposite side portion 274. The support member 262 is thus asymmetrical about a middle axis B that passes through the middle of the support member. The middle axis B is offset by an amount 266 from the axis A that passes through the middle portion of the sole member 58 and coincides with the center of curvature C of the appendage 162. The boot 260 thus differs from the boot 160 by provision of the asymmetrical heel end support member 262. The support member 262 is otherwise structurally similar to the support member 170.

Thus, if the support member 262 is located at the longitudinal middle portion of the ski 100, the mid-portion of the sole 58 and the pivot center C of the boot 260 are laterally offset by the amount 266 with respect to the longitudinal middle portion of the ski. Such lateral offset of the boot may be desired by experienced skiers for purposes of practicing advanced skiing techniques.

As with the boots 160 and 260, further embodiments of the invention are distinguished by the manner in which either of the support members and the appendage are secured together in an adjusted angular offset position. Thus, the description of such other embodiments will concentrate on the distinctive features of one of the support members and the appendage. The other support member, which will not be described for purposes of brevity, is related functionally and structurally to the described support member in the same manner as the support members 102 and 104 of the boot 10. Thus, description of the securement of the toe end support member to the appendage is omitted to avoid repetitive detail.

Unless otherwise indicated, description of the additional embodiments, for purposes of simplicity, is directed to the manner in which the heel end support member is joined to the appendage.

Figure 8:
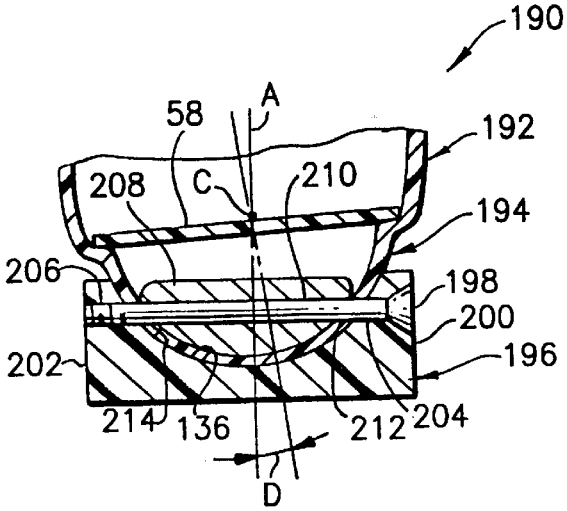
FIGS. 8–10 are fragmentary sectional views of still other embodiments of the invention.

Another embodiment of the adjustable foot equipment, also in the form of a ski boot of the type previously described, is generally indicated by the reference number 190 in FIG. 8. As with the boots 160 and 260, the description of the boot 190 will concentrate on the modified support member securement arrangement since the boot 190 is otherwise similar in structure and operation to the boot 10.

The boot 190 includes a foot retention portion 192 identical to the foot retention portion 14 and an appendage 194. The appendage 194 is of the same general shape as the appendage 30 but has no preformed slots or screw openings.

The boot 190 further includes a heel end support member 196 which accommodates a screw 198. The screw 198 extends across opposite sides 200 and 202 of the heel end support member 196. An unthreaded hole 204 is provided in the side 200 for the head end of the screw 198 and a threaded hole 206 is provided in the opposite side 202 to receive the threaded end of the screw 198. The heel end support member 196 is otherwise identical to the heel end support member 104.

A connection member 208 provided inside the appendage 194 has a bore 210 for the screw 198. The connection member 208 is otherwise identical to the connection member 84.

The boot 190 is used in a manner similar to that previously described for the boot 10. Thus, a selected angular offset D from the vertical reference axis A is provided between heel end support member 196 and the foot retention portion 192. The heel end support member 196 and the appendage 194 are held in the selected offset position by the screw 198.

For example, with the support member 196 and the appendage loosely held in the offset D position, holes are drilled into the offset appendage 194 in alignment with the screw holes 204 and 206 of the support member 196. Thus, a hole 212 is drilled into the appendage 194 in alignment with the unthreaded hole 204 in the side wall 200 of the support member 196. An opposite hole 214 is drilled in the appendage 194 in alignment with the threaded hole 206 in the side wall 202 of the support member 196.

The screw 198 is passed through the side wall opening 204 of the support member 196, into the drilled hole 212 of the appendage 194, through the bore 210 of the connection member 208, into the drilled hole 214 of the appendage 194 and threaded into the threaded hole 206 of the side wall 202 of the support member 196. Tightening of the screw 198 fixes the selected angular offset D between the foot retention member 194 and the support member 196. The angular offset D corrects a corresponding off-vertical orientation of a skier's legs. If desired, slight changes from the angular offset adjustment D can be made by enlarging the drilled holes 212 and 214 in the appendage 194.

Figure 9:
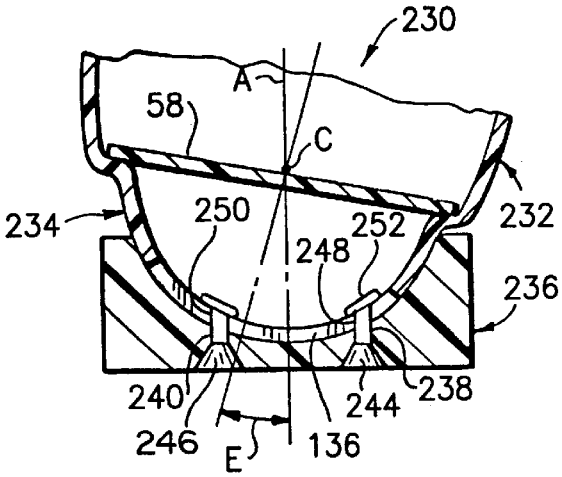

A further embodiment of the adjustable foot equipment, such as a ski boot, is generally indicated by the reference number 230 in FIG. 9. The boot 230 differs from previous embodiments in the manner of establishing an angular offset between the appendage and the support member.

The boot 230 includes a foot retention portion 232 identical to the foot retention portion 14, and an appendage 234. The appendage 234 is of the same general shape as the appendage 30 but has no preformed slots or openings.

The boot 230 further includes a support member such as a heel end support member 236 that is similar to the support member 104 but includes a pair of rivet openings 238 and 240 instead of the screw holes 148 and 150.

In using the boot 230, an angular offset E is provided between the support member 236 and the foot retention portion 232, based on a measurement of an individual's off-vertical leg orientation. The offset relationship is fixed by riveting the support member 236 directly to the appendage 234. Thus, with the support member and the appendage 234 held at the desired angular offset E, a rivet 244 is directed into the rivet opening 238 of the support member 236. The rivet 244 passes through the appendage 234 at an opening 248 created by the rivet 244 as the rivet penetrates the appendage 234. The rivet 244 is installed using any suitable known automatic riveting device that creates its own rivet penetration opening and forms a clamping head such as 252 during installation.

A rivet 246 identical to the rivet 244 is similarly installed in the rivet opening 240 of the support member 236, to form an opening 250 in the appendage 234 during such installation.

It should be noted that use of the rivets 244 and 246 is intended to provide only one permanent angular offset adjustment E of the boot 230, unless the rivets are removed and replaced at a different offset location.

Figure 11:
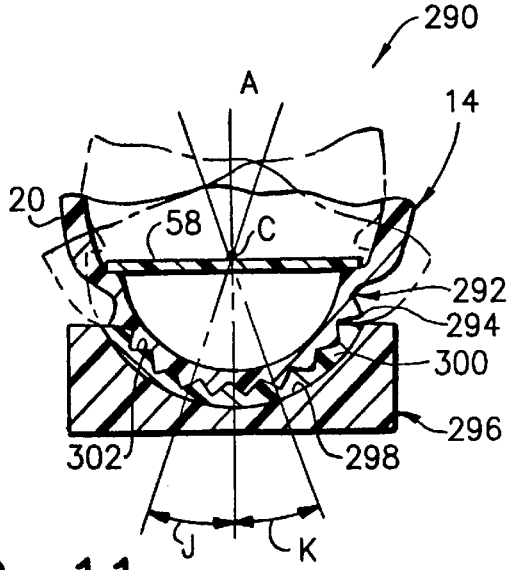
FIG. 11 is a fragmentary sectional view of still another embodiment of the invention.

Another embodiment of the adjustable foot equipment, such as a ski boot, is generally indicated by the reference number 290 in FIG. 11.

The boot 290 includes a foot retention portion 14, and an appendage 292 having elongated teeth or serrations 294 formed on an outer surface. The appendage 292 is otherwise of the same general shape as the appendage 30.

The boot 290 further includes a support member 296 with a concave surface 298 similar to the concave surface 136. The concave surface 298 accommodates a toothed insert 300. The toothed insert 300 which is shaped to conform to the concave surface 298 is formed with teeth 302 that mesh with the teeth 294 of the appendage 292.

The insert 300 can be bonded to the concave surface 298 of the support member 296. If desired, the insert 300 and the support member 296 can be formed integrally, as by molding.

Angular adjustments between the support member 296 and the foot retention portion 14 such as indicated by J or K in FIG. 11 can be secured by, for example, using screws with connection members (not shown), as in the boot 10, or rivets (not shown) without a connection member, as in the boot 230. The support member 296 can thus be provided with screw holes (not shown) or rivet holes (not shown) as needed.

If desired, the toothed engagement between the appendage 294 and the support member 296 can be adapted to the angular offset securement arrangement of any of the previously described embodiments.

It is intended that the adjustable foot equipment need not be limited to a ski boot structure.

Figure 17:
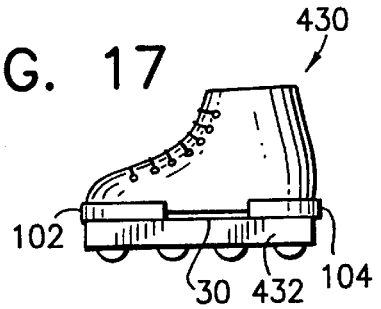
FIGS. 17–19 are further embodiments of the invention.

The appendages and support member structure of any previously described embodiments can be incorporated in other foot equipment such as an in-line roller skate 430 (FIG. 17) wherein the in-line roller member 432 is attached to the support members such as 102 and 104 in any suitable known manner. The support members 102 and 104 are secured to the appendage using any of the previously described techniques. If desired, a single combined toe and heel support member, such as the support member 64 (FIG. 16), can be used to hold the in-line roller member 432.

Figure 18:
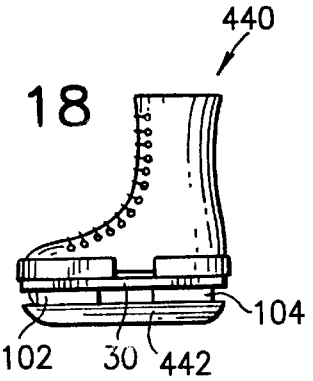

In another embodiment of the invention, the adjustable foot equipment is adapted to an ice skate 440 (FIG. 18). An appendage such as the appendage 30 is provided at the base of the ice skate boot and the support members 102 and 104 are secured to the appendage 30 in a manner similar to that previously described for other embodiments of the invention. An ice skate runner 442 is secured to the support members 102 and 104 in any suitable known manner.

Figure 19:
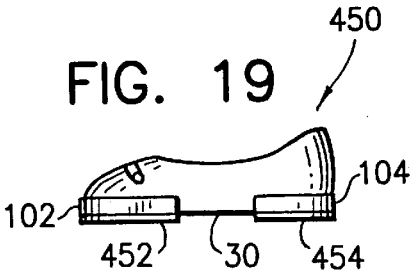

In a further embodiment of the invention, the adjustable foot equipment is adapted to a walking or running shoe 450 (FIG. 19). The shoe 450 is formed with the appendage 30 at the base of the shoe. The support members 102 and 104 are joined to the appendage 30 using any of the previously described techniques. The support members 102 and 104 can be formed as sole and heel members. Separate sole and heel components such as 452 and 454 can be joined to the support members 102 and 104. If desired, a single combined toe and heel support member such as the support member 64 (FIG. 16) can be used in combination with a single continuous sole and heel member (not shown) of the type commonly used in running shoes.

Figure 22:
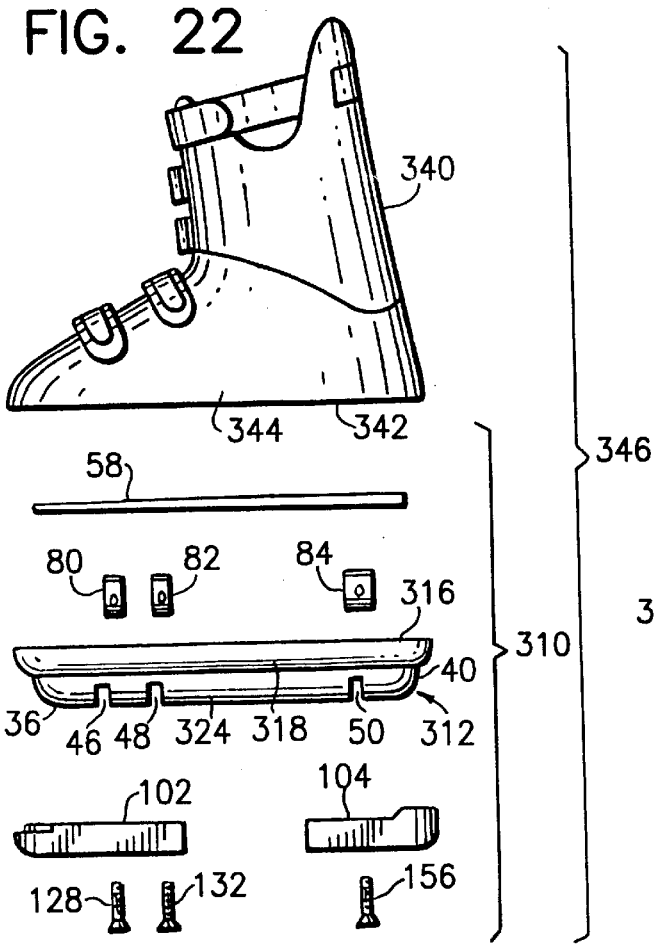
FIG. 22 is an exploded view of a kit prior to incorporation with the bottomless ski boot of FIG. 21.
Figure 23:
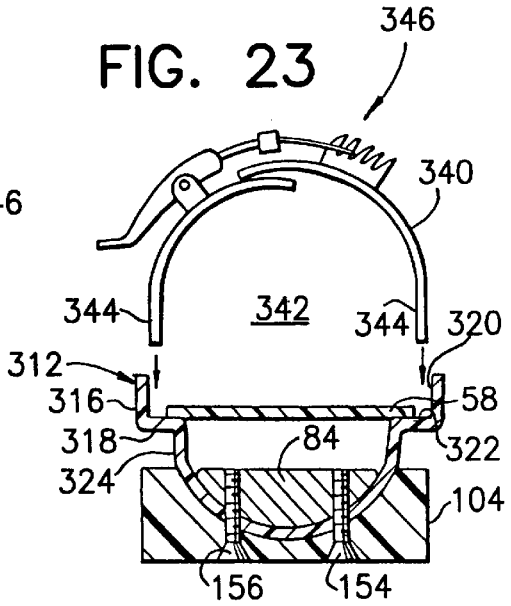
FIG. 23 is a partially exploded sectional view of a kit prior to incorporation with the bottomless ski boot of FIGS. 21 and 22.

Referring to FIGS. 22 and 23, a further embodiment of the invention includes a kit 310 (FIG. 22) for converting conventional foot equipment to adjustable foot equipment.

The kit 310 includes the sole member 58, the connection members 80, 82 and 84, an appendage member 312, and the toe and heel support members 102 and 104 with securement screws such as 128, 132 and 156.

The appendage member 312 includes a marginal wall 316 that extends upwardly from a base portion 318. The base portion 318 is similar in form to the base 32 of the boot 10. A bonding surface 320 (FIG. 23) is defined at the inside of the marginal wall 316.

The base portion 318 defines an internal ledge 322 similar to the ledge 56 of the boot 10. The appendage member 312 further includes an appendage portion 324 depending from the base portion 318. The appendage portion 324 is similar in form to the appendage 30 of the boot 10.

Figure 20:
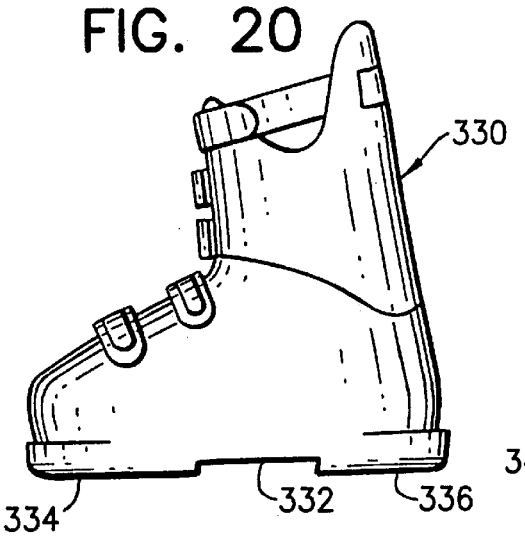
FIG. 20 is a simplified elevational view of a conventional ski boot.
Figure 21:
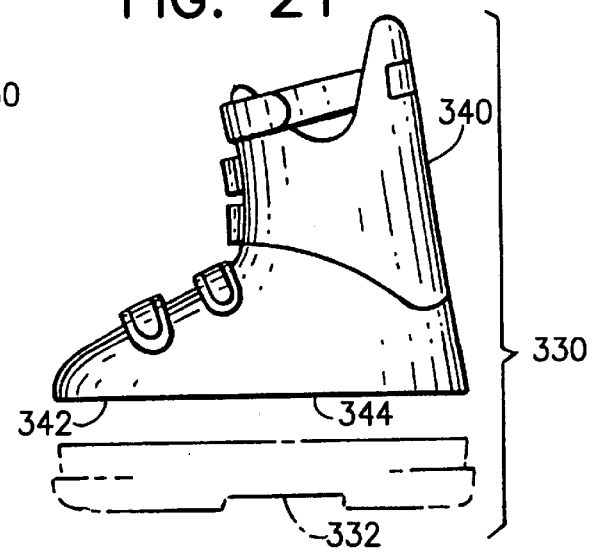
FIG. 21 is a view similar to FIG. 20 with the bottom portion of the ski boot removed.

The kit 310 is intended for use on a conventional plastic ski boot such as indicated by the reference number 330 (FIG. 20). The boot 330 has a base portion 332 with known toe and heel DIN portions 334 and 336.

The base portion 332 is removed by cutting the boot 330 in any suitable known manner to yield a baseless boot portion 340 having an open bottom portion 342. Referring to FIG. 23, the open bottom portion 342 is disposed in the appendage member 312 to engage the bonding surface 320 of the marginal wall 316. Any suitable known bonding material such as an epoxy resin, for example Reichhold Resin Dion Ver9100, is coated on the bonding surface 320 of the appendage member 312. Bonding material can also be applied to a bottom marginal outside surface portion 344 of the baseless boot 340 to join the baseless boot 340 to the appendage member 312.

The connection members 80, 82 and 84 are disposed in the appendage 324 to engage with the support members 102 and 104. The support members 102 and 104 are secured to the connection members 80, 82 and 84 in a manner similar to that previously described for the boot 10 to form an adjustable foot equipment 346, that is structurally and functionally similar to the boot 10. Under this arrangement, the support members 80, 82 and 84 can be set to a desired angle with respect to the boot portion 340, also as previously described. The sole member 58 is disposed on the ledge 322 after the support members 102 and 104 have been secured in their respective adjusted positions.

Kits 310 are intended to be used to form adjustable ice skates, adjustable in-line roller skates and other adjustable foot equipment that would benefit the user by being adjustable in the manner disclosed herein.

Figure 24:
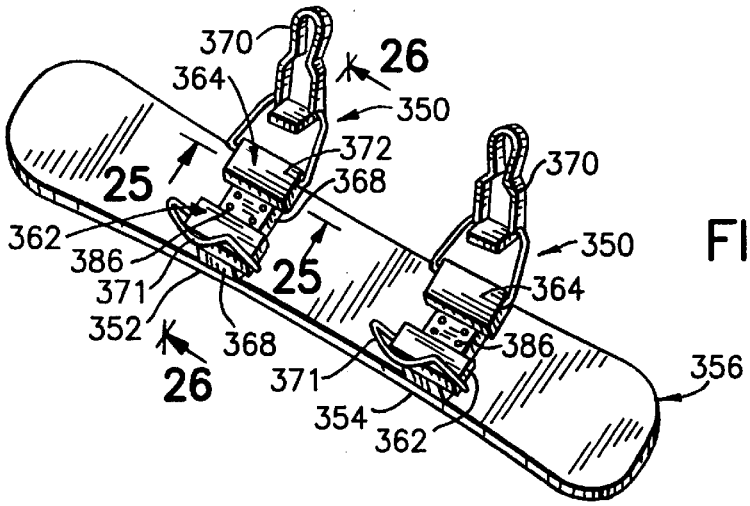
FIG. 24 is a simplified schematic perspective view of adjustable foot equipment incorporating a further embodiment of the invention.

Still another embodiment of the adjustable foot equipment, adaptable to a snowboard, is generally indicated by the reference number 350 in FIG. 24. Identical adjustable foot equipment 350 is provided at two foot stations, 352 and 354 on a snowboard 356.

Figure 26:
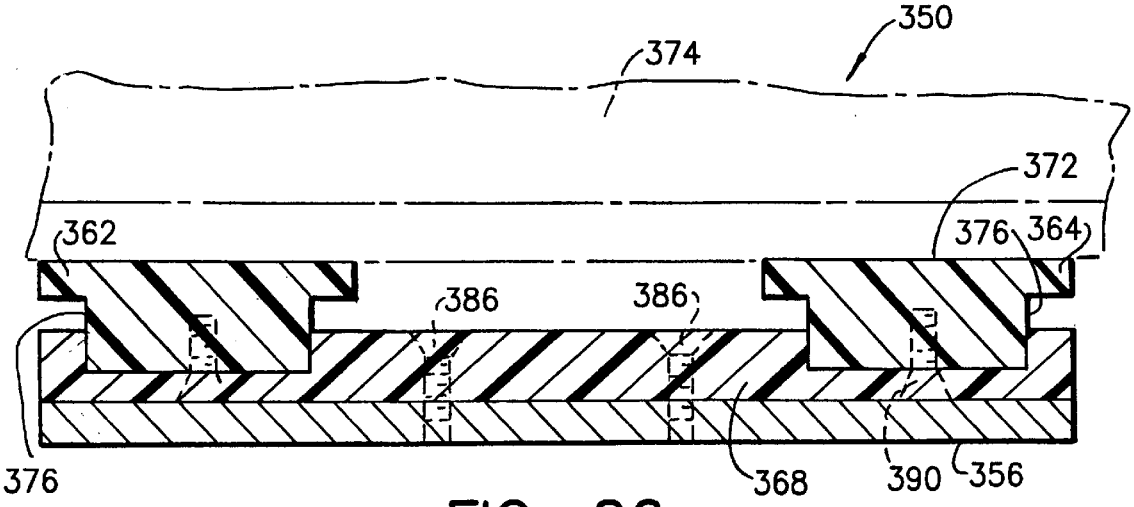
FIG. 26 is a fragmentary sectional view thereof taken on the line 26—26 of FIG. 24.

As most clearly shown in FIG. 26, the adjustable foot equipment 350 includes a toe end appendage portion 362 and a heel end appendage portion 364, joined to a support piece 368 that is secured to the snowboard 356. Known bindings 370 and 371 are provided on the appendage portions 362 and 364.

Figure 25:
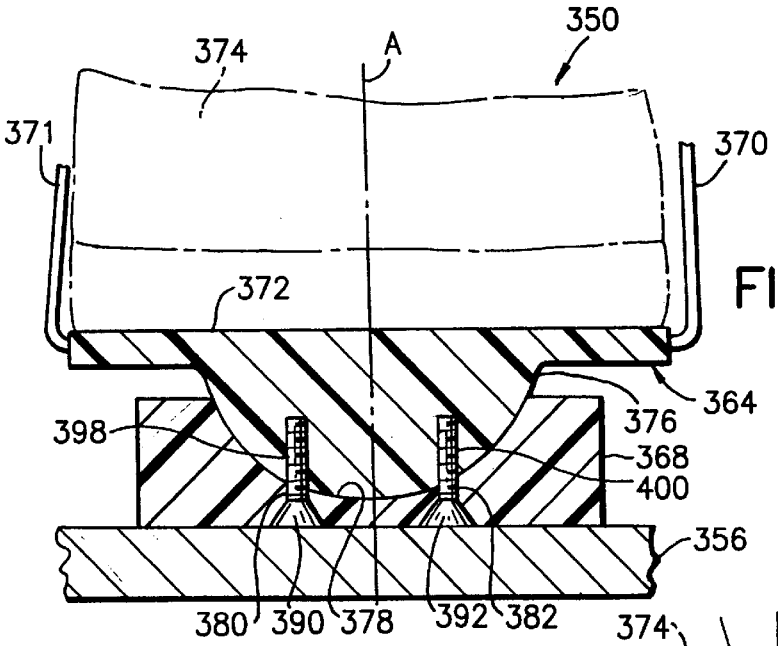
FIG. 25 is an enlarged fragmentary sectional view taken on the line 25—25 of FIG. 24.

Referring to FIGS. 24–26, the heel end appendage portion 364 includes a boot surface 372 which accommodates a known snowboard boot 374. The heel end appendage portion 364 includes a depending semi-cylindrical appendage formation 376.

The support piece 368 includes a concave surface 378 that accommodates the appendage formation 376 and a pair of pre-formed screw openings 380 and 382. A plurality of screws 386 secure the support piece 368 to the snowboard 356.

The toe end appendage 362 is similar in form to the heel end appendage 364 and is similarly engaged by the support piece 368.

Figure 25A:
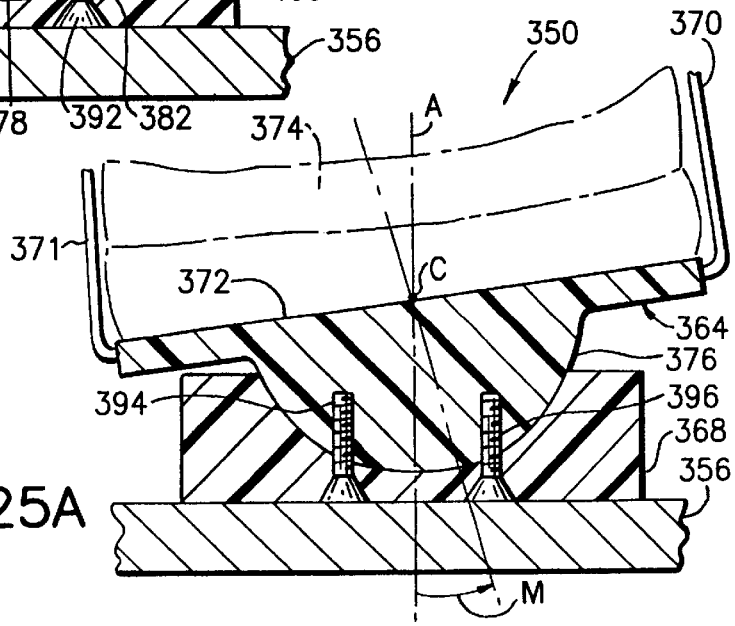
FIG. 25A is a fragmentary sectional view similar to FIG. 25 showing a different angular offset adjustment thereof.

Referring to FIG. 25A, a desired offset angular adjustment M between the heel end appendage 364 and the support piece 368 is secured by screws 390 and 392. The screws 390 and 392 are threaded into drilled openings, such as 394 and 396, in the semi-cylindrical appendage formation 374. The drilled openings 388 and 390 are provided in the appendage 374 at the time the angular offset adjustment is established between the support piece 368 and the heel end appendage 374 (FIG. 23A). If no angular offset adjustment is required, drilled openings 398 and 400 (FIG. 25) that are normal to the foot surface 372 are provided in the appendage 374.

In similar fashion the toe end appendage portion 362 is secured in the same offset angular position as the heel end appendage portion 364. Preferably the offset angular adjustments of the heel and toe end appendage portions 362 and 364 are fixed before the support piece 368 is fastened or otherwise joined to the snowboard 356.

Once the foot equipment 350 is adjusted as described, a snowboarder, outfitted with known boots, joins such boots to the foot equipment 350 by stepping onto the boot surface 372 and securing the bindings 370 and 371. It should be noted that in this embodiment there is no requirement that the center of curvature of the appendage portions 362 and 364 coincide with the boot surface 372.

Figure 27:
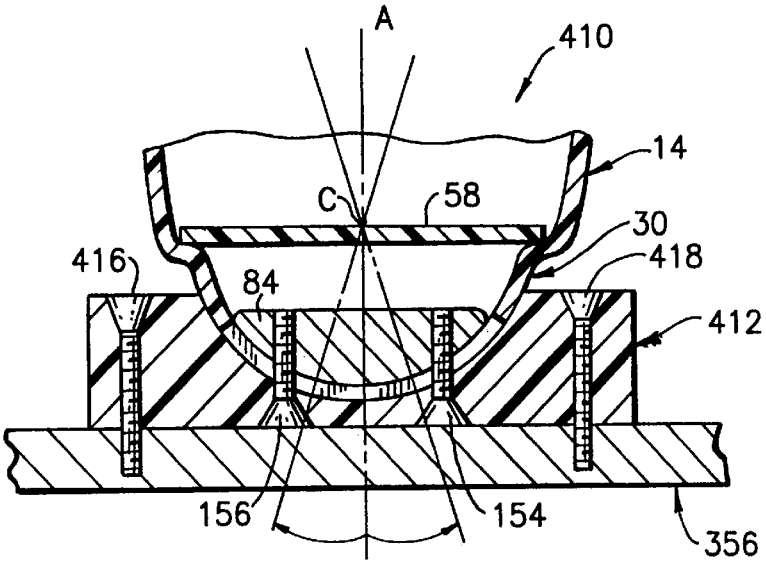
FIG. 27 is a fragmentary sectional view of another embodiment of the invention.

Another embodiment of the adjustable foot equipment, also adaptable to a snowboard, is generally indicated by the reference number 410 in FIG. 27. The adjustable foot equipment 410 includes the foot retention portion 14 engageable with a support member 412. The support member 412 is similar to the one-piece support member 64 of FIG. 15. The support member 412 is joined to the snowboard 356 with screws such as 416 and 418.

Although the offset condition is not shown in FIG. 27, an angular offset P or Q between the foot retention member 14 and the support member 412 is accomplished in a manner similar to that previously described for the boot 10. Preferably the foot equipment 410 is adjusted for a desired angular offset between the support member 412 and the foot retention portion 14 before such support member 412 is secured to the snowboard 356.

The foot equipment 410 permits the making of more than one different angular adjustment and thus facilitates experimentation with a variety of angular adjustments in accordance with the user's individual requirements. It should also be noted that the angular offset used by a snowboarder need not be based on off-vertical leg orientation, but upon a deliberate inclination of standing posture with respect to a snowboard based on preferences by a snowboarder. The invention facilitates the setting of such selected inclinations when desired.

As will be apparent to persons skilled in the art, the adjustable foot equipment can be used to provide a deliberate off-vertical leg orientation of predetermined amount, no matter what the user's normal leg orientation may be.

Some advantages of the invention evident from the foregoing description include adjustable foot equipment that permits provision of an offset angular adjustment to compensate for off-vertical orientation of the legs. A desired adjusted leg orientation can be established when the user is wearing the adjustable foot equipment or the foot equipment can be adjusted separately from the user based on a measurement of the user's off-vertical leg orientation. A further advantage is that the adjustable foot equipment can be adjusted with the simplest of tools and requires no special mechanical skills to carry out such adjustment. Another advantage is that the adjustable foot equipment is adaptable to different types of foot equipment. Still another advantage is that a kit embodying the invention can be used to convert non-adjustable foot equipment to adjustable foot equipment.

In view of the above, it will be seen that the several objects of the invention are achieved and other advantageous results attained.

As various changes can be made in the above constructions and method without departing from the scope of the invention, it is intended that all matter contained in the above description or shown in the accompanying drawings shall be interpreted as illustrative and not in a limiting sense.

What is claimed is:

1. Adjustable foot equipment comprising a) a foot holding means having a toe end and a heel end for accommodating a foot, said foot holding means having a base portion with a curved bottom surface, b) substantially rigid support means at said base portion, said support means including a toe portion at the toe end of the foot holding means and a heel portion at the heel end of the foot holding means, said support means having one side configured to receive the curved bottom surface of said base portion such that the toe portion and the heel portion of said support means engage said base portion to permit relative rotatable movement between said foot holding means and the toe and heel portions of said support means to selected angular orientations with respect to each other about an axis extending longitudinally of the base portion of said foot holding means, and said support means having an opposite side configured to permit engagement of said opposite side against a flat surface, c) securing means for locking said support means and said base portion together at one of said selected angular orientations between the toe and heel portions of said support means and said foot holding means.

2. The adjustable foot equipment as claimed in claim 1 wherein said base portion includes a depending appendage, having the curved bottom surface, and the toe and heel portions of said support means each having a conforming surface complementary with the curved bottom surface of said appendage to receive the curved bottom surface.

3. The adjustable foot equipment as claimed in claim 2 wherein the curved bottom surface of the appendage and the conforming surface of each of the toe and heel portions of the support means are circular in cross-section.

4. The adjustable foot equipment as claimed in claim 3 wherein said curved bottom surface of said appendage is convex and the conforming surface of each of the toe and heel portions of said support means is concave.

5. The adjustable foot equipment as claimed in claim 2 wherein said appendage includes a solid portion and said securing means includes a fastener that extends from said support means for engagement in the solid portion of said appendage.

6. The adjustable foot equipment as claimed in claim 2, wherein said appendage includes a hollow portion.

7. The adjustable foot equipment as claimed in claim 6, said securing means including a connection member provided in the hollow portion of said appendage.

8. The adjustable foot equipment as claimed in claim 7 wherein said appendage has a wall portion and said securing means further includes a fastener that extends from said support means through the wall of said appendage to said connection member to sandwich the wall of said appendage between said support means and said connection member.

9. The adjustable foot equipment as claimed in claim 8 wherein said appendage has a wall portion and said securing means includes a fastener that extends from said support means into said appendage to lock said support means to said appendage.

10. The adjustable foot equipment as claimed in claim 1 wherein said support means is formed as a pair of spaced support members, one of the spaced support members being the toe portion and the other of the spaced support members being the heel portion.

11. The adjustable foot equipment as claimed in claim 1 wherein said foot holding means include a device for holding a boot in position on said support means.

12. The adjustable foot equipment as claimed in claim 1 wherein the opposite side of said support means is a flat surface.

13. The adjustable foot equipment as claimed in claim 11 wherein said device for holding a boot is formed to hold a boot selected from the group consisting of ski boots, snowboard boots, and water ski boots.

14. Adjustable foot equipment comprising a) a foot holding means having a toe end and a heel end for accommodating a foot, said foot holding means having a base portion with a curved bottom surface, b) at least one substantially rigid support member at the toe end and at the heel end of the foot holding means, said support member having an upper surface configured to receive the curved bottom surface of said base portion to permit relative rotatable movement between said foot holding means and said support member to selected angular orientations with respect to each other about an axis extending longitudinally of the base portion of said foot holding means, and said support member having a lower substantially flat surface, and c) securing means for locking said support member and said base portion together at one of said selected angular orientations between said support member and said foot holding means.

15. The adjustable foot equipment as claimed in claim 14 including two of said support members, one of said support members being at the toe end of said foot holding means and the other of said support members being at the heel end of said foot holding means.

16. The adjustable foot equipment as claimed in claim 15 wherein said base portion has a boot support surface and said foot holding means includes a boot locking device for locking a boot against the boot support surface.

17. Adjustable foot equipment comprising a) a foot pivoting means having a toe end and a heel end and a base portion with a curved bottom surface, b) substantially rigid support means at said base portion, said support means including a toe portion at the toe end of the foot pivoting means and a heel portion at the heel end of the foot pivoting means, said support means having one side configured to receive the curved bottom surface of said base portion such that the toe portion and the heel portion of said support means engage said base portion to permit relative rotatable movement between said foot pivoting means and the toe and heel portions of said support means to selected angular orientations with respect to each other about an axis extending longitudinally of the base portion of said foot pivoting means, and said support means having an opposite side configured to permit engagement of said opposite side against a flat surface, c) securing means for locking said support means and said base portion together at one of said selected angular orientations between the toe and heel portions of said support means and said foot pivoting means.

18. The adjustable foot equipment as claimed in claim 17 wherein said base portion includes a depending appendage, having the curved bottom surface, and the toe and heel portions of said support means each having a conforming surface complementary with the curved bottom surface of said appendage to receive the curved bottom surface.

19. The adjustable foot equipment as claimed in claim 18 wherein the curved bottom surface of the appendage and the conforming surface of each of the toe and heel portions of the support means are circular in cross-section.

20. The adjustable foot equipment is claimed in claim 17 wherein the foot pivoting means is joined to a ski.

* * * * *